US007828088B2

(12) United States Patent
Middlemiss et al.

(10) Patent No.: US 7,828,088 B2
(45) Date of Patent: Nov. 9, 2010

(54) THERMALLY STABLE ULTRA-HARD MATERIAL COMPACT CONSTRUCTION

(75) Inventors: Stewart N. Middlemiss, Salt Lake City, UT (US); J. Daniel Belnap, Pleasant Grove, UT (US); Nephi Mourik, Provo, UT (US); Thomas W. Oldham, The Woodlands, TX (US); Anthony Griffo, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 30 days.

(21) Appl. No.: 12/127,656

(22) Filed: May 27, 2008

(65) Prior Publication Data

US 2008/0223621 A1 Sep. 18, 2008

Related U.S. Application Data

(63) Continuation of application No. 11/140,482, filed on May 26, 2005, now Pat. No. 7,377,341.

(51) Int. Cl.
*E21B 10/26* (2006.01)
*B24D 3/00* (2006.01)

(52) U.S. Cl. ..... 175/374; 175/426; 51/307; 51/309

(58) Field of Classification Search ..... 175/434, 175/374; 51/307, 309; 428/212, 408
See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | Lai |
| 3,233,988 | A | 2/1966 | Wentorf, Jr. et al. |
| 3,745,623 | A | 7/1973 | Wentorf, Jr. et al. |
| 4,108,614 | A | 8/1978 | Mitchell |
| 4,151,686 | A | 5/1979 | Lee et al. |
| 4,224,380 | A | 9/1980 | Bovenkerk et al. |

(Continued)

FOREIGN PATENT DOCUMENTS

| | | |
|---|---|---|
| EP | 0300699 | 1/1989 |

(Continued)

OTHER PUBLICATIONS

Search Report for GB 0610460.8 dated Sep 22, 2006, total 2 pages.

*Primary Examiner*—William P Neuder
(74) *Attorney, Agent, or Firm*—Connolly Bove Lodge & Hutz LLP

(57) ABSTRACT

Thermally stable ultra-hard compact constructions of this invention comprise an ultra-hard material body that includes a thermally stable region positioned adjacent a surface of the body. The thermally stable region is formed from consolidated materials that are thermally stable at temperatures greater than about 750° C. The thermally stable region can occupy a partial portion of or the entire ultra-hard material body. The ultra-hard material body can comprise a composite of separate ultra-hard material elements that each form different regions of the body, at least one of the regions being thermally stable. The ultra-hard material body is attached to a desired substrate, an intermediate material is interposed between the body and the substrate, and the intermediate material joins the substrate and body together by high pressure/high temperature process.

20 Claims, 6 Drawing Sheets

U.S. PATENT DOCUMENTS 4,255,165 A 3/1981 Dennis et al.
4,268,276 A 5/1981 Bovenkerk
4,288,248 A 9/1981 Bovenkerk et al.
4,303,442 A 12/1981 Hara et al.
4,311,490 A 1/1982 Bovenkerk et al.
4,373,593 A 2/1983 Phaal et al.
4,387,287 A 6/1983 Marazzi
4,412,980 A 11/1983 Tsuji et al.
4,481,016 A 11/1984 Campbell et al.
4,486,286 A 12/1984 Lewin et al.
4,504,519 A 3/1985 Zelez
4,522,633 A 6/1985 Dyer
4,525,179 A 6/1985 Gigl
4,534,773 A 8/1985 Phaal et al.
4,556,403 A 12/1985 Almond et al.
4,560,014 A 12/1985 Geczy
4,570,726 A 2/1986 Hall
4,572,722 A 2/1986 Dyer
4,604,106 A 8/1986 Hall
4,605,343 A 8/1986 Hibbs, Jr. et al.
4,606,738 A 8/1986 Hayden
4,621,031 A 11/1986 Scruggs
4,636,253 A 1/1987 Nakai et al.
4,645,977 A 2/1987 Kurokawa et al.
4,662,348 A 5/1987 Hall et al.
4,664,705 A 5/1987 Horton et al.
4,670,025 A 6/1987 Pipkin
4,707,384 A 11/1987 Schachner et al.
4,726,718 A 2/1988 Meskin et al.
4,766,040 A 8/1988 Hillert et al.
4,776,861 A 10/1988 Frushour
4,784,023 A 11/1988 Dennis
4,792,001 A 12/1988 Zijsling
4,793,828 A 12/1988 Burnand
4,797,241 A 1/1989 Peterson et al.
4,802,539 A 2/1989 Hall et al.
4,807,402 A 2/1989 Rai
4,828,582 A 5/1989 Frushour
4,844,185 A 7/1989 Newton, Jr. et al.
4,861,350 A 8/1989 Phaal et al.
4,871,377 A 10/1989 Frushour
4,882,128 A 11/1989 Hukvari et al.
4,899,922 A 2/1990 Slutz et al.
4,919,220 A 4/1990 Fuller et al.
4,931,068 A 6/1990 Dismukes et al.
4,933,529 A 6/1990 Saville et al.
4,940,180 A 7/1990 Martell
4,943,488 A 7/1990 Sung et al.
4,944,772 A 7/1990 Cho
4,976,324 A 12/1990 Tibbitts
5,011,514 A 4/1991 Cho et al.
5,027,912 A 7/1991 Juergens
5,030,276 A 7/1991 Sung et al.
5,032,147 A 7/1991 Frushour
5,068,148 A 11/1991 Nakahara et al.
5,092,687 A 3/1992 Hall
5,116,568 A 5/1992 Sung et al.
5,127,923 A 7/1992 Bunting et al.
5,135,061 A 8/1992 Newton, Jr.
5,176,720 A 1/1993 Martell et al.
5,186,725 A 2/1993 Martell et al.
5,199,832 A 4/1993 Meskin et al.
5,205,684 A 4/1993 Meskin et al.
5,213,248 A 5/1993 Horton et al.
5,238,074 A 8/1993 Tibbitts et al.
5,264,283 A 11/1993 Waldenstrom et al.
5,337,844 A 8/1994 Tibbitts
5,369,034 A 11/1994 Hargett et al.
5,370,195 A 12/1994 Keshavan et al.
5,379,853 A 1/1995 Lockwood et al.
5,439,492 A 8/1995 Anthony et al.
5,464,068 A 11/1995 Najafi-Sani
5,468,268 A 11/1995 Tank et al.
5,496,638 A 3/1996 Waldenstrom et al.
5,505,748 A 4/1996 Tank et al.
5,510,193 A 4/1996 Cerutti et al.
5,523,121 A 6/1996 Anthony et al.
5,524,719 A 6/1996 Dennis
5,560,716 A 10/1996 Tank et al.
5,607,024 A 3/1997 Keith et al.
5,620,382 A 4/1997 Cho et al.
5,624,068 A 4/1997 Waldenstrom et al.
5,645,617 A 7/1997 Frushour
5,667,028 A 9/1997 Truax et al.
5,718,948 A 2/1998 Ederyd et al.
5,722,499 A 3/1998 Nguyen et al.
5,776,615 A 7/1998 Wong et al.
5,833,021 A 11/1998 Mensa-Wilmot et al.
5,897,942 A 4/1999 Karner et al.
5,954,147 A 9/1999 Overstreet et al.
5,979,578 A 11/1999 Packer
6,009,963 A 1/2000 Chaves et al.
6,063,333 A 5/2000 Dennis
6,123,612 A 9/2000 Goers
6,126,741 A 10/2000 Jones et al.
6,165,616 A 12/2000 Lemelson
6,202,770 B1 3/2001 Jurewicz et al.
6,234,261 B1 5/2001 Evans et al.
6,248,447 B1 6/2001 Griffin et al.
6,269,894 B1 8/2001 Griffin
6,302,225 B1 10/2001 Yoshida et al.
6,344,149 B1 2/2002 Oles
6,410,085 B1 6/2002 Griffin et al.
6,435,058 B1 8/2002 Matthias et al.
6,443,248 B2 9/2002 Yong et al.
6,544,308 B2 4/2003 Griffin et al.
6,562,462 B2 5/2003 Griffin et al.
6,585,064 B2 7/2003 Griffin et al.
6,589,640 B2 7/2003 Griffin et al.
6,592,985 B2 7/2003 Griffin et al.
6,601,662 B2 8/2003 Matthias et al.
6,739,214 B2 5/2004 Griffin et al.
6,749,033 B2 6/2004 Griffin et al.
6,797,326 B2 9/2004 Griffin et al.
6,892,836 B1 5/2005 Eyre
7,462,003 B2 * 12/2008 Middlemiss ..... 407/119
7,473,287 B2 * 1/2009 Belnap et al. ..... 51/307
7,517,589 B2 * 4/2009 Eyre ..... 428/408
7,647,993 B2 * 1/2010 Middlemiss ..... 175/433
2005/0050801 A1 3/2005 Cho
2005/0115744 A1 * 6/2005 Griffin et al. ..... 175/434
2005/0129950 A1 6/2005 Griffin et al.
2005/0230156 A1 * 10/2005 Belnap et al. ..... 175/375
2005/0263328 A1 12/2005 Middlemiss
2006/0060390 A1 3/2006 Eyre
2006/0060392 A1 3/2006 Eyre et al.
2006/0165993 A1 7/2006 Keshavan
2007/0181348 A1 8/2007 Lancaster et al.

FOREIGN PATENT DOCUMENTS

EP 0329954 8/1989
EP 0500253 8/1992
EP 0595630 5/1994
EP 0612868 8/1994
EP 0617207 9/1994
EP 0787820 8/1997
EP 0860515 8/1998
EP 1116858 7/2001
EP 1190791 3/2002
EP 1958688 8/2008
GB 1349385 4/1974
GB 2048927 12/1980
GB 2268768 1/1994

| | | |
|---|---|---|
| GB | 2270493 | 3/1994 |
| GB | 2323398 | 9/1998 |
| GB | 2351747 | 1/2001 |
| GB | 2367081 | 3/2002 |
| GB | 2408735 | 6/2005 |
| GB | 2413575 | 11/2005 |
| GB | 2418215 | 3/2006 |
| GB | 2422623 | 8/2006 |
| JP | 60187603 | 10/1984 |
| JP | 59219500 | 12/1984 |
| WO | 9323204 | 11/1993 |
| WO | 9634131 | 10/1996 |
| WO | 0028106 | 5/2000 |
| WO | 2004040095 | 5/2004 |
| WO | 2004106003 | 12/2004 |
| WO | 2004106004 | 12/2004 |

* cited by examiner

THERMALLY STABLE ULTRA-HARD MATERIAL COMPACT CONSTRUCTION

FIELD OF THE INVENTION

This invention generally relates to ultra-hard materials and, more specifically, to ultra-hard materials having an improved degree of thermal stability when compared to conventional ultra-hard materials such as polycrystalline diamond, and that are joined to a substrate to facilitate attachment of the overall construction for use in a desired cutting and/or drilling application.

BACKGROUND OF THE INVENTION

Ultra-hard materials such as polycrystalline diamond (PCD) and PCD elements formed therefrom are well known in the art. Conventional PCD is formed by combining diamond grains with a suitable solvent catalyst material to form a mixture. The mixture is subjected to processing conditions of extremely high pressure/high temperature, where the solvent catalyst material promotes desired intercrystalline diamond-to-diamond bonding between the grains, thereby forming a PCD structure. The resulting PCD structure produces enhanced properties of wear resistance and hardness, making PCD materials extremely useful in aggressive wear and cutting applications where high levels of wear resistance and hardness are desired.

Solvent catalyst materials typically used in forming conventional PCD include metals from Group VIII of the Periodic table, with cobalt (Co) being the most common. Conventional PCD can comprise from 85 to 95% by volume diamond and a remaining amount of the solvent catalyst material. The solvent catalyst material is present in the microstructure of the PCD material within interstices that exist between the bonded together diamond grains.

A problem known to exist with such conventional PCD materials is that they are vulnerable to thermal degradation during use that is caused by differential thermal expansion characteristics between the interstitial solvent catalyst material and the intercrystalline bonded diamond. Such differential thermal expansion is known to occur at temperatures of about 400° C., which can cause ruptures to occur in the diamond-to-diamond bonding that can result in the formation of cracks and chips in the PCD structure.

Another form of thermal degradation known to exist with conventional PCD materials is also related to the presence of the solvent metal catalyst in the interstitial regions and the adherence of the solvent metal catalyst to the diamond crystals. Specifically, the solvent metal catalyst is known to cause an undesired catalyzed phase transformation in diamond (converting it to carbon monoxide, carbon dioxide, or graphite) with increasing temperature, thereby limiting practical use of the PCD material to about 750° C.

Attempts at addressing such unwanted forms of thermal degradation in conventional PCD are known in the art. Generally, these attempts have involved techniques aimed at treating the PCD body to provide an improved degree of thermal stability when compared to the conventional PCD materials discussed above. One known technique involves at least a two-stage process of first forming a conventional sintered PCD body, by combining diamond grains and a cobalt solvent catalyst material and subjecting the same to high pressure/high temperature process, and then subjecting the resulting PCD body to a suitable process for removing the solvent catalyst material therefrom.

This method produces a PCD body that is substantially free of the solvent catalyst material, hence is promoted as providing a PCD body having improved thermal stability. A problem, however, with this approach is that the lack of solvent metal catalyst within the PCD body precludes the subsequent attachment of a metallic substrate to the PCD body by brazing or other similar bonding operation.

The attachment of such substrates to the PCD body is highly desired to provide a PCD compact that can be readily adapted for use in many desirable applications. However, the difference in thermal expansion between the PCD bodies formed according to this technique and the substrate, and the poor wetability of the PCD body diamond surface due to the substantial absence of solvent metal catalyst, makes it very difficult to bond the thermally stable PCD body to conventionally used substrates. Accordingly, PCD bodies that are rendered thermally stable according to this technique must be attached or mounted directly to a device for use, i.e., without the presence of an adjoining substrate.

Since such conventionally formed thermally stable PCD bodies are devoid of a metallic substrate, they cannot (e.g., when configured for use as a drill bit cutter) be attached to a drill bit by conventional brazing process. Rather, the use of such a thermally stable PCD body in such an application requires that the PCD body itself be mounted to the drill bit by mechanical or interference fit during manufacturing of the drill bit, which is labor intensive, time consuming, and which does not provide a most secure method of attachment.

It is, therefore, desired that an ultra-hard material construction be developed that includes an ultra-hard material body having improved thermal stability when compared to conventional PCD materials, and that includes a substrate material attached to the ultra-hard material body to facilitate attachment of the resulting compact construction to an application device by conventional method such as welding or brazing and the like. It is further desired that such a product can be manufactured cost effectively, without the use of exotic materials or manufacturing techniques.

SUMMARY OF THE INVENTION

Thermally stable ultra-hard compact constructions of this invention generally comprise a body formed from an ultra-hard material that includes a thermally stable region positioned adjacent a working surface of the body. The thermally stable region can be formed from consolidated materials that are thermally stable at temperatures greater than about 750° C., and in some embodiment are thermally stable at temperatures greater than about 1,000° C. In an example embodiment, the thermally stable region can be formed from consolidated materials having a grain hardness of greater than about 4,000 HV. Example ultra-hard materials useful for forming the ultra-hard material body of this invention include diamond, cubic boron nitride, diamond-like carbon, other materials in the boron-nitrogen-carbon phase diagram that display hardness values similar to that of cubic boron nitride, and certain other ceramic materials such as boron carbide. Thus, the resulting sintered ultra-hard material body can comprise polycrystalline diamond, bonded diamond, polycrystalline cubic boron nitride, boron carbo-nitrides, hard ceramics, and combinations thereof.

Depending on the end use application, the thermally stable region can occupy the entire ultra-hard material body, or may occupy a partial section or portion of the ultra-hard material body. Further, the ultra-hard material body can have a construction characterized by a homogenous material microstructure, or can comprise a composite or laminate construction formed from a combination of ultra-hard material layers, bodies or elements, which can include materials that are less hard.

The ultra-hard material body can be attached to a desired substrate, thereby forming a compact. The interfacing surfaces between the ultra-hard material body and the substrate can have a planar or nonplanar configuration. Suitable substrates include those formed from carbides, nitrides, carbonitrides, cermet materials, and mixtures thereof. An intermediate material can be interposed between the layers, bodies or elements used to form the substrate, and can be used to join the substrate and body together. Multiple layers of intermediate materials may also be used for instance to optimize the bonding between the ultra-hard material body and the substrate and/or to better match the thermal expansion characteristics of the substrate and the body to control or minimize any residual stresses that may result from sintering.

Materials useful for forming the intermediate material include carbide forming materials such as refractory metals, ceramic materials, and non-carbide forming materials such as non-refractory metals, and alloys of these materials. In an example embodiment, the intermediate material is one that does not infiltrate into the ultra-hard material body during high pressure/high temperature processing and that can operate as a barrier to prevent migration of constituent materials from the substrate to the ultra-hard material body.

The ultra-hard material body, intermediate material, and substrate are joined together by high pressure/high temperature process. During this high pressure/high temperature process, any ultra-hard material elements, bodies, or layers that are combined are joined together to form a desired composite ultra-hard material body, and the body is joined to the substrate. Ultra-hard material compact constructions of this invention provide improved properties of thermal stability when compared to conventional PCD, which is desired for certain demanding wear and/or cutting applications.

Additionally, thermally stable ultra-hard compact constructions of this invention, constructed having a substrate, facilitate attachment of the compact by conventional method, e.g., by brazing, welding and the like, to enable use with desired wear and/or cutting devices, e.g., to function as wear and/or cutting elements on bits used for subterranean drilling.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

As used herein, the term "PCD" is used to refer to polycrystalline diamond formed at high pressure/high temperature (HPHT) conditions, through the use of a solvent metal catalyst, such as those materials included in Group VIII of the Periodic table. PCD still retains the solvent catalyst in interstices between the diamond crystals. "Thermally stable diamond" as used herein is understood to refer to bonded diamond that is substantially free of the solvent metal catalyst used to form PCD, or the solvent metal catalyst used to form PCD remains in the diamond body but is otherwise reacted or otherwise rendered ineffective in its ability adversely impact the bonded diamond at elevated temperatures as discussed above.

Thermally stable compact constructions of this invention have a body formed from an ultra-hard material specially engineered to provide an improved degree of thermal stability when compared to conventional PCD materials. Thermally stable compacts of this invention are thermally stable at temperatures greater than about 750° C., and for some demanding applications are thermally stable at temperatures greater than about 1,000° C. The body can comprise one or more different types of ultra-hard materials that can be arranged in one or more different layers or bodies that are joined together. In an example embodiment, the body can include an ultra-hard material in the form of PCD that may or may not be substantially free of a catalyst material.

Thermally stable compact constructions of this invention further include a substrate that is joined to the ultra-hard material body that facilitates attachment of the compact constructions to cutting or wear devices, e.g., drill bits when the compact is configured as a cutter, by conventional means such as by brazing and the like. An intermediate layer is preferably interposed between the body and the substrate. The intermediate layer can facilitate attachment between the body and substrate, can provide improved matching of thermal expansion characteristics between the body and substrate, and can act as a barrier to prevent infiltration of materials between the substrate and body during HPHT conditions.

Generally speaking, thermally stable compact constructions of this invention are formed during two or more HPHT processes, wherein a first HPHT process is employed to form a desired ultra-hard material that eventually becomes at least a region of the compact construction, and a second subsequent HPHT process is employed to produce the compact construction comprising at least a thermally stable region in the ultra-hard material body and a substrate connected to the body. Prior to the second HPHT process, the ultra-hard material is itself treated or is combined with one or more other ultra-hard material bodies or elements to render all or a region of the resulting body thermally stable.

Figure 1:
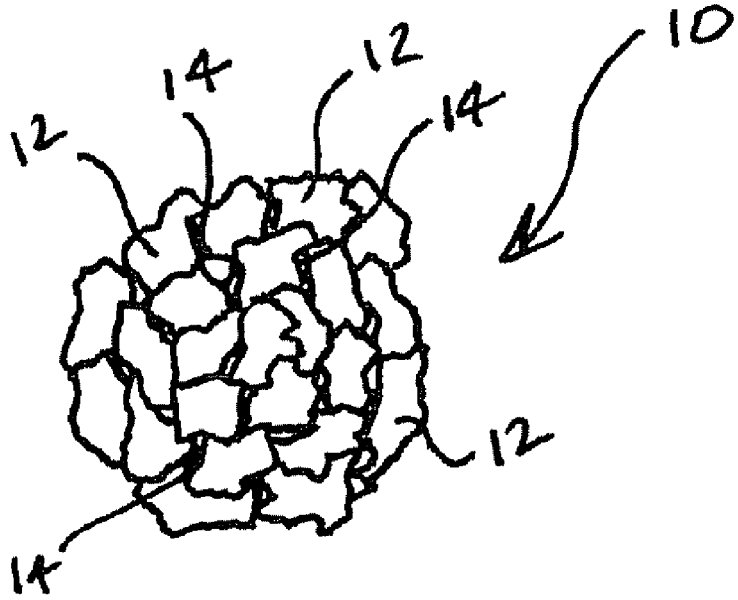
FIG. 1 is a schematic view of a region of an ultra-hard material prepared in accordance with principles of this invention.

FIG. 1 illustrates a region of an ultra-hard material 10 formed during a first HPHT processing step according to this invention. In an example embodiment, the ultra-hard material 10 is PCD having a material microstructure comprising a material phase 12 of intercrystalline bonded diamond made up of bonded together adjacent diamond grains at HPHT conditions. The PCD material microstructure also includes regions 14 disposed interstially between the bonded together adjacent diamond grains. During the first HPHT process, the solvent metal catalyst used to facilitate the bonding together of the diamond grains moves into and is disposed within these interstitial regions 14.

Figure 2:
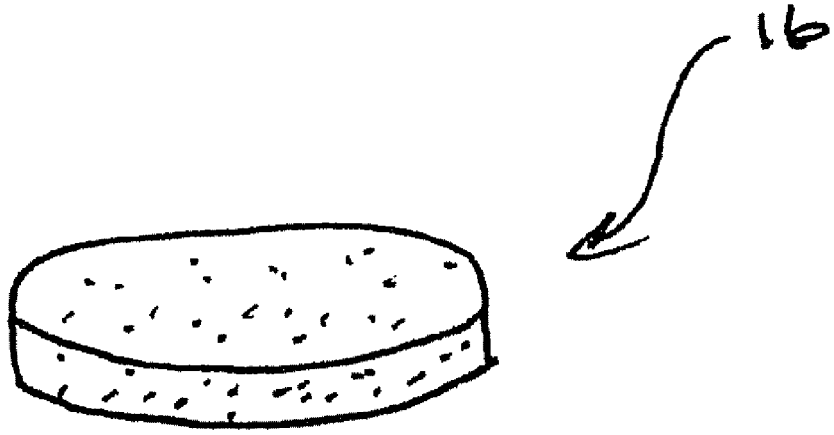
FIG. 2 is a perspective view of an ultra-hard material body of this invention.

FIG. 2 illustrates an example ultra-hard material body 16 formed in accordance with this invention by HPHT process. The ultra-hard material body is illustrated having a generally disk-shaped configuration with planar upper and lower surfaces, and a cylindrical outside wall surface. It is understood that this is but a preferred configuration and that ultra-hard material bodies of this invention can be configured other than specifically disclosed or illustrated, e.g., having a non-planar upper or lower surface, and/or having an cylindrical outside wall surface. In an example embodiment, the ultra-hard material body is one that is formed from PCD.

Diamond grains useful for forming PCD in the ultra-hard material body during a first HPHT process according to this invention include diamond powders having an average diameter grain size in the range of from submicrometer in size to 100 micrometers, and more preferably in the range of from about 5 to 80 micrometers. The diamond powder can contain grains having a mono or multi-modal size distribution. In an example embodiment, the diamond powder has an average particle grain size of approximately 20 micrometers. In the event that diamond powders are used having differently sized grains, the diamond grains are mixed together by conventional process, such as by ball or attrittor milling for as much time as necessary to ensure good uniform distribution.

The diamond grain powder is preferably cleaned, to enhance the sinterability of the powder by treatment at high temperature, in a vacuum or reducing atmosphere. The diamond powder mixture is loaded into a desired container for placement within a suitable HPHT consolidation and sintering device.

The device is then activated to subject the container to a desired HPHT condition to consolidate and sinter the diamond powder mixture to form PCD. In an example embodiment, the device is controlled so that the container is subjected to a HPHT process comprising a pressure in the range of from 4 to 7 GPa and a temperature in the range of from 1,300 to 1500° C., for a period of from 1 to 60 minutes. In a preferred embodiment, the applied pressure is approximately 5.5 GPa, the applied temperature is approximately 1,400° C., and these conditions are maintained for a period of approximately 10 minutes.

During this first HPHT process, the solvent metal catalyst within the diamond mixture melts and infiltrates the diamond powder to facilitate diamond-to-diamond bonding between adjacent diamond grains. During such diamond-to-diamond bonding, the solvent metal catalyst moves into the interstitial regions within the so-formed PCD body between the bonded together diamond grains.

The container is removed from the device and the resulting PCD body is removed from the container. As noted above, in an example embodiment, the PCD body is formed by HPHT process without having a substrate attached thereto. Alternatively, the PCD body can be formed having a substrate attached thereto during the first HPHT process by loading a desired substrate into the container adjacent the diamond powder prior to HPHT processing. An advantage of forming a PCD body without an attached substrate during the first HPHT process is that it enables further processing of the PCD body according to the practice of this invention without having to remove the substrate, which can be done by grinding or grit blasting with an airborne abrasive, or otherwise taking steps to protect the substrate from further treatment. A further advantage of forming a PCD body without an attached substrate during this first HPHT process is that it allows improved economics by producing more PCD material in a given cell press.

Once formed, the PCD body is treated to render a region thereof or the entire body thermally stable. This can be done, for example, by removing substantially all of the solvent metal catalyst therefrom by suitable process, e.g., by acid leaching, aqua regia bath, electrolytic process, or combinations thereof. Alternatively, rather than removing the solvent metal catalyst therefrom, all or a region of the PCD body can be rendered thermally stable by treating the solvent metal catalyst in a manner that renders it unable to adversely impact the diamond bonded grains on the PCD body at elevated temperatures. In an example embodiment, all or a desired region of the PCD body is rendered thermally stable by removing substantially all of the solvent metal catalyst therefrom by acid leaching technique as disclosed for example in U.S. Pat. No. 4,224,380, which is incorporated herein by reference.

In an example embodiment, where acid leaching is used to remove the solvent metal catalyst, a portion of or the entire PCD body is immersed in the acid leaching agent for a sufficient time so that the resulting thermally stable region projects inwardly into the body from the exposed surfaces. In the event that the PCD body is formed having an attached substrate, such substrate is removed prior to the treatment process to facilitate solvent metal catalyst removal from what was the substrate interface surface of the PCD body. Alternatively, the substrate can be protected by suitable technique.

Figure 3A:
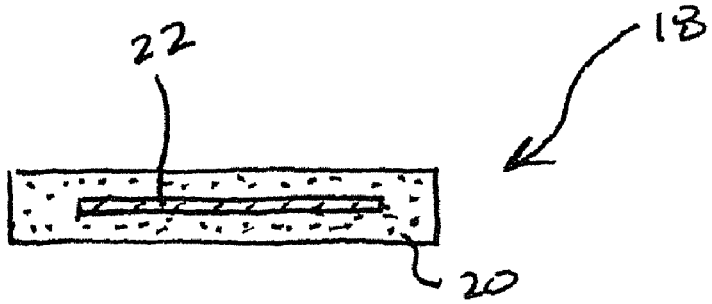
FIG. 3A is a cross-sectional side view of an example embodiment thermally stable ultra-hard material body of this invention.

In one example embodiment, the PCD body is subjected to acid leaching so that the entire body is rendered thermally stable, i.e., the entire diamond body is substantially free of the solvent metal catalyst. FIG. 3A illustrates an embodiment of the ultra-hard material body 18 of this invention, formed from PCD, that has been treated in the manner described above, by immersing the entire body in a desired acid-leaching agent. In this particular embodiment, the ultra-hard material body includes a thermally stable diamond region 20 that projects inwardly a desired depth from the different outer surfaces of the body and that is substantially free of the solvent metal catalyst.

However, unlike the first embodiment noted above including an ultra-hard material body that is rendered completely thermally stable, the ultra-hard material body 18 of this embodiment is also formed from PCD and is treated to leave a remaining PCD region 22 that is not leached. It is to be understood that, depending on how the diamond body is treated, the thermally stable and PCD regions of the body may be positioned differently in such an embodiment that is not entirely leached. Generally, it is desired that a surface portion, e.g., a working surface, of the ultra-hard material diamond body be engineered to provide a desired degree of thermal stability in a region of the body subjected to cutting or wear exposure.

For those invention embodiments comprising an ultra-hard material body with a partial thermally stable region, the depth or thickness of the thermally stable region is understood to vary depending on the particular use application. For example, in some applications it may be desired to have a thermally stable region that extends a depth of less than about 0.1 mm from a surface of the body, e.g., in the range of from about 0.02 to 0.09 mm from the surface. In other applications it may be desired that the thermally stable region extends a depth of at least about 0.1 mm or greater, e.g., from about 0.1 mm to 4 mm.

In the embodiment of the ultra-hard material body illustrated in FIG. 3A, the PCD region 22 is positioned inwardly of the thermally stable regions 20 and, more specifically, is encapsulated by the thermally stable diamond regions. This is but one example embodiment of the invention that is prepared comprising an ultra-hard material body that is not entirely thermally stable. Alternative embodiments of ultra-hard material bodies of this invention comprising a thermally stable region that occupies a partial portion of the body include those where the thermally stable region extends a depth from one or more surfaces of the body. In the example illustrated in FIG. 3A, the thermally stable region extends from all surfaces of the body to leave a remaining encapsulated PCD region.

The embodiment illustrated in FIG. 3A may be desired for ultra-hard material compact constructions of this invention used in cutting or drilling applications calling for certain levels of abrasion and wear resistance at the surface of the compact, while also calling for certain levels of impact resistance and fracture toughness. In such applications, the presence of a PCD region within the body beneath the working surface or working surfaces can operate to provide an improved degree of impact resistance and fracture toughness to the compact when compared to a diamond body lacking such PCD region, i.e., that is entirely thermally stable.

Figure 3B:
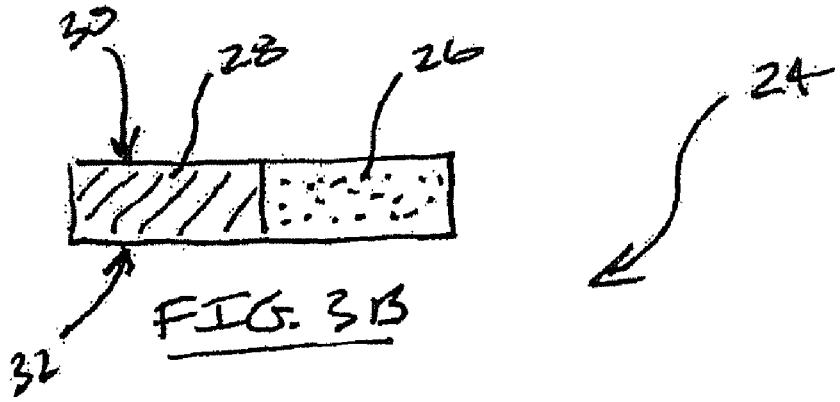
FIG. 3B is a cross-sectional side view of another alternative example embodiment thermally stable ultra-hard material body of this invention.

FIG. 3B illustrates another embodiment of an ultra-hard material body 24 of this invention also formed from PCD and that has been treated in the manner described above to provide both a thermally stable diamond region 26 and a PCD region 38. However, unlike the embodiment described above and illustrated in FIG. 3A, in this particular embodiment only a portion of the PCD body is subjected to the acid-leaching agent so that a remaining portion retains the solvent metal catalyst after the treatment is completed. For example, a portion of the PCD body is immersed so that both a working surface 30 and an oppositely oriented substrate interface surface 32 of the diamond body includes both regions.

This particular embodiment may be desired for diamond compact constructions used in certain cutting applications. In one example application, the diamond compact may be used in a wear or cutting assembly configured to permit an electrical current flow between the cutting tool and the work piece once a certain degree of wear in the body was reached, indicating that the wear or cutting body was worn. In this embodiment, the thermally stable material (forming the working surface) acts as an electrical insulator, whereas the conventional PCD body (attached to the tool post) is electrically conductive. Thus, assuming an electrically conductive work piece, the diamond compact construction can be configured to produce a current flow between the work piece and the compact once a portion of the thermally stable diamond region has worn sufficiently to place the PCD region into contact with the work piece, thereby providing an indication that replacement of the compact was needed.

When the ultra-hard material body is formed from PCD, and at least a portion of it has been treated to form the desired thermally stable region, it is readied for a second HPHT process used to attach the diamond body to one or more other bodies or substrates.

It is to be understood that PCD is but one type of ultra-hard material useful for forming the ultra-hard material body of this invention, and that other types of ultra-hard materials having the desired combined properties of wear resistance, hardness, and thermal stability can also be used for this purpose. Suitable ultra-hard materials for this purpose include, for example, those materials capable of demonstrating physical stability at temperatures above about 750° C., and for certain applications above about 1,000° C., that are formed from consolidated materials. Example materials include those having a grain hardness of greater than about 4,000 HV. Such materials can include, in addition to diamond, cubic boron nitride (cBN), diamond-like carbon, boron suboxide, aluminum manganese boride, and other materials in the boron-nitrogen-carbon phase diagram which have shown hardness values similar to cBN and other ceramic materials.

Although the ultra-hard material body described above and illustrated in FIGS. 2, 3A and 3B was formed from a single material, e.g., PCD, at least a portion of which was subsequently rendered thermally stable, it is to be understood that ultra-hard material bodies prepared in accordance with this invention can comprise a number of different regions, layers, bodies, or volumes formed from the same or different type of ultra-hard materials, or ultra-hard materials in combination with other materials than may be less hard. An example of such less hard materials that may be used in combination with the above-noted ultra-hard materials to form ultra-hard material bodies of this invention include ceramic materials that have relatively high hardness values such as silicon carbide, silicon nitride, aluminum nitride, alumina, titanium carbide/nitride, titanium diboride and cermets such as tungsten-carbide-cobalt.

Again, a feature of such ultra-hard material bodies, whether they are formed from a single material or a laminate or composite of different materials, is that they demonstrate an improved degree of thermal stability at the working, wear or cutting surface when compared to conventional PCD.

For example, the ultra-hard material body can be provided having a number of different layers, bodies, or regions formed from the same or different type of ultra-hard materials or less hard materials that are each joined together during a HPHT process. The different layers or bodies can be provided in the form of different powder volumes, green-state parts, sintered parts, or combinations thereof.

Figure 3C:
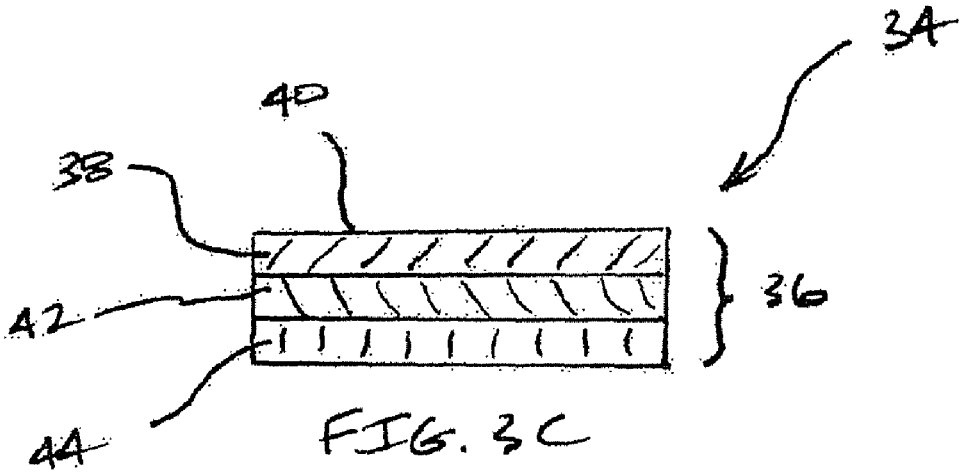
FIG. 3C is a cross-sectional side view of another embodiment of the thermally stable ultra-hard material body of this invention.

FIG. 3C illustrates an example embodiment of such a composite ultra-hard material body 34 comprising a number of multiple regions 36. In this particular embodiment, the composite body 34 includes a first material region 38 that extends a depth from a body working surface 40, a second material region 42 that extends a depth from the first material region 38, and a third material region 44 that extends a depth from the second material region 42. In such an embodiment, the first material region is an ultra-hard material formed from cBN, the second material region is an ultra-hard material formed from PCD that has been rendered thermally stable in the manner discussed above, and the third material region is an ultra-hard material formed from PCD. Alternatively, the different material regions can be formed from any of the suitable ultra-hard materials or less hard materials noted above, and will be likely be selected based on the particular use application.

The three ultra-hard material regions in this particular embodiment are provided as layers, and may each be separate elements or bodies that are joined together during HPHT processing, or one or more of the layers can be integral elements that are already joined together. For example, in this particular embodiment, the second material region 42 and the third material region 44 can each be part of a one-piece construction that was partially treated in the manner described above to render the second material region thermally stable.

It is to be understood that this is but a reference example of one of many different embodiments that can exist for ultra-hard material bodies of this invention comprising a composite construction of multiple layers, bodies or regions of ultra-hard materials and less hard materials, and that other combinations and configurations of material regions making up such composite ultra-hard material bodies are intended to be within the scope and spirit of this invention.

In an example embodiment where the ultra-hard material body is one formed from a single-type of ultra-hard material, e.g., the PCD body as discussed above and as illustrated in FIGS. 3A and 3B that was treated to render at least a portion of which thermally stable, such ultra-hard material body is combined with a desired substrate and is loaded into a container as described above, and the container is placed into a device that subjects the container to a HPHT condition.

In an example embodiment where the ultra-hard material body is a composite comprising a number of regions formed from a number of material bodies, layers, or regions, e.g., as illustrated in FIG. 3C, the separate bodies or layers are combined together in the desired ordered arrangement and this arrangement is combined with a desired substrate and is loaded into a container as described above, and the container is placed into a device that subjects the container and its contents to a HPHT condition.

The substrate to be attached to the ultra-hard material body during this second HPHT process to form the thermally stable compact of this invention can include those selected from the same general types of materials conventionally used to form substrates for conventional PCD materials and include carbides, nitrides, carbonitrides, cermet materials, and mixtures thereof. In an example embodiment, such as that where the compact is to be used with a drill bit for subterranean drilling, the substrate can be formed from cemented tungsten carbide (WC—Co). The substrate used in the second HPHT process can be provided in the form of a powder volume, can be provided in form of a green-state unsintered part, can be provided in the form of a sintered part, or combinations thereof.

If desired, one or both of the adjacent interface surfaces of the ultra-hard material body and the substrate can be shaped having a planar or nonplanar geometry. For example, it may be desirable to preshape one or both of the interface surfaces to have cooperating nonplanar surface features to provide an improved degree of mechanical engagement with one another, and to provide an increased surface area therebetween which acts to increase the load capacity of the bonded engagement. As noted below, in the event that such a nonplanar interface is used, the substrate material may be provided in the form of powder or as a green-state part to minimize unwanted stresses that may be imposed on the ultra-hard material body during the HPHT process.

Depending on the particular type of ultra-hard material present at the substrate interface and/or the type of substrate that is used, it may or may not be necessary to use an intermediate material or layer or layers between the substrate and the ultra-hard material body. The intermediate layer can be used to facilitate attachment between the body and substrate, and/or to prevent any unwanted migration of material from the substrate into the ultra-hard material body or visa versa. Additionally, the intermediate material can help to accommodate any mismatch in mechanical properties that exist between the body and substrate, e.g., differences in thermal expansion characteristics, that may create high residual stresses in the construction during sintering. Additionally the intermediate material can be selected to provide a structure capable of forming a better bond to the materials to be joined than without using the intermediate layer. For example, in the case where the substrate is formed from a ceramic material, a sufficient degree of bonding for certain end use applications may occur between the ultra-hard material body and ceramic material by mechanical interlocking or bonding through reaction synthesis such that the use of an intermediate material is not necessary. However, depending on the material composition of the substrate and/or the ultra-hard material at the ultra-hard material body substrate interface, the use of an intermediate material or layer may indeed be necessary to provide a desired level of bonding therebetween.

The type of materials useful for forming the intermediate layer will depend on such factors as the material composition of the ultra-hard material body and/or substrate, and the desired strength or type of bond to be formed therebetween for a certain application. An additional factor that may influence the choice of material is whether the interface surfaces between the substrate and ultra-hard material body have a planar or nonplanar configuration. Example materials suitable for forming the intermediate include those that can be broadly categorized as carbide forming materials, ceramic materials, and non-carbide forming materials.

Carbide forming materials suitable for use as the intermediate layer include those that are capable of carburizing or reacting with carbon, e.g., diamond, in the ultra-hard material body and/or substrate during HPHT conditions. Suitable carbide forming materials include refractory metals such as those selected from Groups IV through VII of the Periodic table. Examples include W, Mo, Zr and the like.

When interposed between the ultra-hard material body and the substrate and subjected to HPHT conditions, such refractory metals may diffuse into one or both of the adjacent bodies and undergo reaction with carbon present in the ultra-hard material body and/or substrate to form carbide. This carbide formation operates to provide a degree of bonding between the adjacent ultra-hard material body and substrate. Additionally, during the HPHT process, the refractory metal material softens and undergoes plastic deformation, which plastic deformation operates to provide an enhanced degree of mechanical interlocking bonding between the adjacent ultra-hard material body and/or substrate.

A feature of such carbide forming materials useful as an intermediate layer is that they be capable of forming a bond between the ultra-hard material body and substrate by HPHT process without themselves infiltrating into the ultra-hard material body and without causing or permitting any unwanted infiltration of any solvent metal catalyst present in the substrate into the ultra-hard material body during the process, i.e., acting as a barrier layer. Thus, it is understood that such intermediate materials do not melt into a liquid form during the HPHT process and for this reason do not infiltrate into the ultra-hard material body. Thus, such carbide-forming intermediate materials have a melting temperature that is greater than that of the HPHT process that the intermediate material is subjected to.

Ceramic materials useful for forming an intermediate material or layer include those capable of undergoing a desired degree of plastic deformation during HPHT conditions to provide a desired mechanical interlocking bond between the ultra-hard body material and substrate. Example ceramic materials include TiC, $Al_2O_3$, $Si_3N_4$, SiC, SiAlON, TiN, $ZrO_2$, WC, $TiB_2$, AlN and $SiO_2$, also $Ti_XAlM_Y$ (where x is between 2-3, M is carbon or nitrogen or a combination of these, and y is between 1-2). Like the carbide forming materials, a key feature of ceramic materials useful for forming the intermediate layer is that they also be capable of forming a bond between the ultra-hard material body and substrate by HPHT process without themselves infiltrating or causing unwanted infiltration of materials present in the substrate into the ultra-hard material body during the HPHT process. Thus, such ceramic intermediate materials have a melting temperature that is greater than that of the HPHT process that the intermediate material is subjected to.

Non-carbide forming materials useful as an intermediate include non-refractory metals and high-strength braze alloys that do not react with carbon in the ultra-hard material body and, thus do not form a carbide. A desired characteristic of such non-refractory metals and high-strength braze alloys is that they be capable of infiltrating into one or both of the ultra-hard material body and substrate during HPHT conditions, and do not act as a solvent metal catalyst. It is further desirable that such non-refractory metals and high-strength braze alloys be capable of melting and infiltrating into the ultra-hard material body and/or substrate at a relatively low temperature, preferably below the melting point of solvent metal catalysts such as cobalt, and forming a bond with the ultra-hard material body of desired bond strength.

Suitable non-refractory metals and high-strength braze alloys include copper, Ni—Cr alloys, and brazes containing high percentages of elements such as palladium and similar high strength materials, and Cn-based active brazes. A particularly preferred non-refractory metal useful as an intermediate material is copper due to its relatively low melting temperature, below that of cobalt, and its ability to form a bond of sufficient strength with the diamond body. The ability to provide an intermediate material having a relatively low melting temperature is desired for the purpose of avoiding potential infiltration of any solvent metal catalyst, from the ultra-hard material body or substrate, into the thermally stable region of the ultra-hard material body. Additionally, this enables the HPHT process used to bond the ultra-hard material body to the substrate to be performed at a reduced temperature, thereby reducing the amount of thermal stress imposed upon the ultra-hard material body during this process. In an example embodiment, it may be desired to use different layers of braze materials to achieve a desired reduction in thermal stress. These materials would not be solvent metal catalyst materials.

While the intermediate material or layer is useful for forming a desired bond between the ultra-hard material body and other body or substrate, in certain circumstances it is also desired that the intermediate material be useful as a barrier layer to prevent the undesired migration of materials contained within the substrate to the ultra-hard material body. For example, when the substrate used is one that is formed from a cermet material including a Group VIII metal of the Periodic table, e.g., WC—Co, it is desired that intermediate material function not only to provide a desired bond between the ultra-hard material body and substrate but function to prevent any unwanted infiltration of the metal, i.e., the solvent metal catalyst cobalt, into the ultra-hard material body. Such infiltration is undesired as it would operate to adversely impact the thermal stability of the ultra-hard material body, e.g., especially in the case where it comprises thermally stable diamond.

The intermediate material can be provided in the form of a preformed layer, e.g., in the form of a foil or the like. Alternatively, the intermediate material can be provided in the form of a green-state part, or can be provided in the form of a coating that is applied to one or both of the interface surfaces of the ultra-hard material body and the substrate. In an example embodiment, the intermediate material can be applied by chemical vapor deposition. It is to be understood that one or more intermediate layers can be used to achieve the desired bonding and/or barrier and or mechanical properties between the ultra-hard material body and the substrate.

In the event that it is desired to use an intermediate material, the intermediate material is interposed between the ultra-hard material body and or substrate in the container that is placed in the HPHT device for HPHT processing. The intermediate material can also be used to bond together any of the bodies, layers or elements used to form separate regions of the ultra-hard material body, e.g., when the body is provided in the form of a laminate or composite construction. Intermediate materials useful in forming the laminate or composite constructions of the ultra-hard material body can be the same as those disclosed above for joining the body to the substrate, and can be used for the same reasons disclosed above, e.g., for providing a desired bond between the different ultrahard material regions, and/or for preventing the unwanted migration of materials therebetween, and/or to provide a better match between one or more mechanical properties between the adjacent layers or bodies.

Once the ultra-hard material body, or multiple bodies used to form a laminate or composite body, and the substrate are loaded into the container with or without any intermediate layer, the container contents is subjected to temperature and pressure conditions sufficient to cause a desired bonding of both any different bodies, layers or regions forming the ultra-hard material body, and the ultra-hard material body to the substrate. The process pressure condition may be in the range of from about 4 to 7 GPa and the process temperature condition may be in the range of from about 1,000° C. to 1,500° C., for a period of from about 1 to 60 minutes. In a preferred embodiment, the applied pressure is approximately 5.5 GPa, the applied temperature is approximately 1,200° C., and these conditions are maintained for a period of approximately 5 minutes. It is to be understood that the HPHT process temperature and pressure will vary depending on, amongst other things, the particular construction of the ultra-hard material body, the type of material used for forming the substrate to be attached thereto, and the presence and type of intermediate material used.

During this second HPHT process, any individual elements or bodies used to form the ultra-hard material body are bonded or joined together, and the ultra-hard material body is bonded or joined to substrate, which can involve mechanical interaction and/or chemical reaction between the adjacent surfaces of the ultra-hard material body elements and/or the intermediate material and/or the substrate, thereby forming a thermally stable ultra-hard material compact of this invention. It is generally desired that the temperature during this HPHT process be less than that of the first HPHT process used to form the PCD body for the purpose of reducing the thermal stress the ultra-hard material body will experience during cooling from the HPHT cycle.

Figure 4:
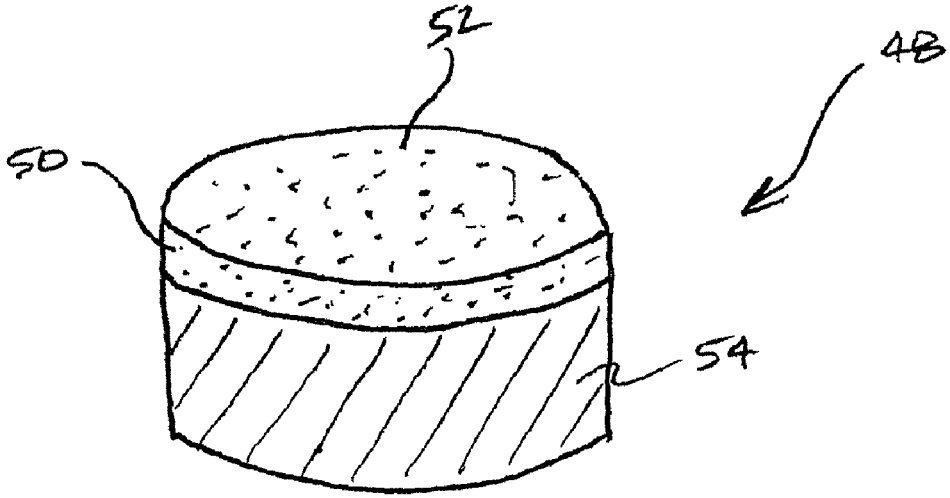
FIG. 4 is a perspective view of a thermally stable ultra-hard material compact construction of this invention.

FIG. 4 illustrates a thermally stable ultra-hard material compact 48 prepared according to principles of this invention including an ultra-hard material body 50 comprising a thermally stable region disposed along working or cutting surface 52 of the body. In the event that the ultra-hard material is PCD, then at least a region of the PCD material has been rendered thermally stable by the treatment discussed above, e.g., by acid leaching to remove the solvent metal catalyst.

The ultra-hard material body 50 is bonded or joined to its constituent elements, if provided in the form of a laminate or composite construction, and is bonded or joined to a substrate 54 according to the second HPHT process disclosed above. In an example embodiment, the ultra-hard material body is formed from PCD that has treated to be rendered entirely thermally stable, and the substrate is formed from WC—Co.

Figure 5:
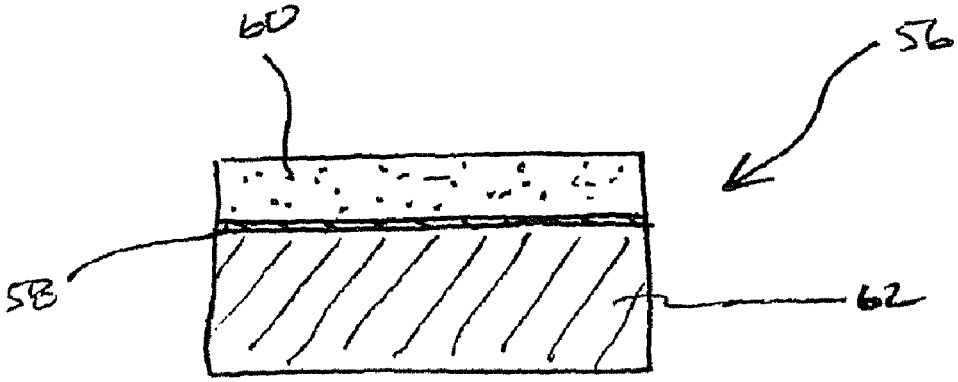
FIG. 5 is a cross-sectional side view of the thermally stable ultra-hard material compact construction of FIG. 4.

FIG. 5 illustrates in cross section a first embodiment thermally stable ultra-hard material compact 56 of this invention comprising one or more intermediate materials or layers 58 interposed between the ultra-hard material body 60 and the substrate 62. The intermediate material 58 forms a desired bond between the body and substrate, operates to prevent any unwanted infiltration of cobalt from the substrate into the body during the second HPHT process, and helps to bridge the transition in thermal expansion characteristic between the body and the substrate to thereby reduce residual stresses therebetween. While the body 60 is shown as comprising a uniform material construction, it is to be understood that the body 60 can have a composite construction as described above formed from a number of individual bodies of materials joined together during the HPHT process.

Figure 6:
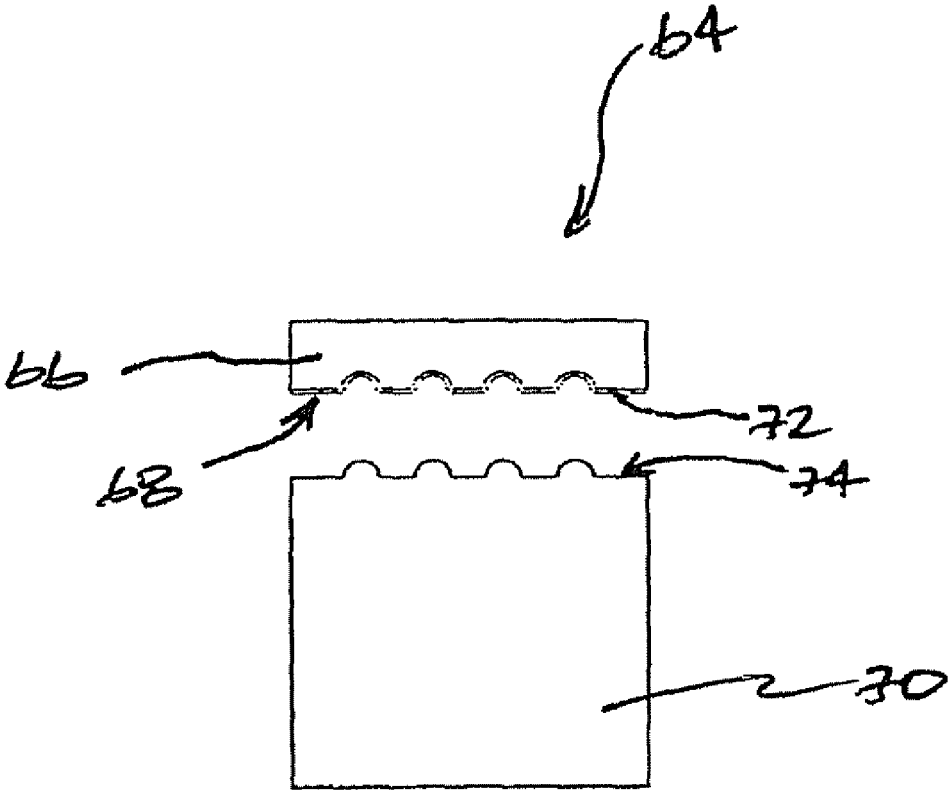
FIG. 6 is a cross-sectional side view of a thermally stable ultra-hard material compact construction of this invention in an unassembled view.

FIG. 6 illustrates in cross section a second embodiment thermally stable ultra-hard material construction 64 of this invention in an unsintered condition prior to the second HPHT process. The construction 64 comprises a thermally stable ultra-hard material body 66 formed in the manner described above, and comprising an interface surface 68 positioned adjacent a substrate 70. In this particular embodiment, the interface surface 68 is configured having nonplanar surface features that enhances mechanical connection between the body and substrate, and that increases surface area between the body and substrate to increase the load capacity of the bond formed therebetween. In this embodiment, an intermediate material 72 is applied to the interface surface 70 in the form of a chemical vapor deposition coating, e.g., formed from TiC, that chemically bonds to the ultra-hard material body and provides a wettable and bondable surface for the substrate 70.

Additionally, the substrate 70 is provided having an interface surface 74 that includes surface features that are configured to complement those of the body to provide the above-noted enhanced mechanical connection therebetween. Additionally, in this embodiment, the substrate is provided as green-state preform part that has been dewaxed prior to placement in the container and being subjected to HPHT processing. In an example embodiment, the substrate comprises a WC—Co green-state preform. The use of a green-state substrate is desired in this embodiment because it permits the substrate to conform slightly to the nonplanar interface surface of the ultra-hard material body, thereby operating to minimize damage to and the creation of unwanted stresses in the construction during the HPHT process. Alternatively, it may not be necessary to use substrate having a preshaped non-planar interface surface when the substrate is provided in the form of powder or a green-state part.

During the HPHT process, the intermediate material coating forms a bond between the adjacent body and substrate interface surfaces and acts as a barrier to prevent cobalt infiltration into the body from the substrate. Additionally, the intermediate material coating has a coefficient of thermal expansion that is closer to the body than that of the substrate, thereby operating to form a transition therebetween for the purpose of controlling and reducing the creation of residual stresses during sintering.

The above-described thermally stable ultra-hard material compact constructions formed according to this invention will be better understood with reference to the following example:

EXAMPLE

Thermally Stable Ultra-Hard Material Compact

Synthetic diamond powders having an average grain size of approximately 2-50 micrometers are mixed together for a period of approximately 2-6 hours by ball milling. The resulting mixture includes approximately six percent by volume cobalt solvent metal catalyst based on the total volume of the mixture, and is cleaned by heating to a temperature in excess of 850° C. under vacuum. The mixture is loaded into a refractory metal container and the container is surrounded by pressed salt (NaCl), and this arrangement is placed within a graphite heating element. This graphite heating element containing the pressed salt and the diamond powder encapsulated in the refractory container is then loaded in a vessel made of a high-pressure/high-temperature self-sealing powdered ceramic material formed by cold pressing into a suitable shape. The self-sealing powdered ceramic vessel is placed in a hydraulic press having one or more rams that press anvils into a central cavity. The press is operated to impose a pressure and temperature condition of approximately 5,500 MPa and approximately 1,450° C. on the vessel for a period of approximately 20 minutes.

During this HPHT processing, the cobalt solvent metal catalyst infiltrates through the diamond powder and catalyzes diamond-to-diamond bonding to form PCD having a material microstructure as discussed above and illustrated in FIG. 1. The container is removed from the device, and the resulting PCD diamond body is removed from the container and subjected to acid leaching. The PCD diamond body has a thickness of approximately 1,500 micrometers. The entire PCD body is immersed in an acid leaching agent comprising hydrofluoric acid and nitric acid for a period time sufficient to render the diamond body substantially free of the solvent metal catalyst.

The so-formed thermally stable diamond body is then prepared for loading into a refractory metal container for further HPHT processing by placing a refractory metal foil layer adjacent an interface surface of the diamond body, and placing a substrate adjacent the refractory metal foil layer. The refractory metal is Molybdenum, and the foil layer has a thickness of approximately 100 micrometers. The substrate is formed from WC—Co and has a thickness of approximately 12 millimeters. The combined thermally stable diamond body, refractory metal foil layer, and substrate are loaded into the container, the container is surrounded by pressed salt (NaCl) and this arrangement is placed within a graphite heating element as noted above for the first HPHT process. This assembly is then loaded in the vessel made of a high-pressure/high-temperature self-sealing powdered ceramic material formed by cold pressing into a suitable shape. The self-sealing powdered ceramic vessel is placed in the hydraulic press, and the press is operated to impose a pressure and temperature condition of approximately 5.5 GPa and approximately 1,200° C. on the vessel for a period of approximately 5 minutes.

During this second HPHT processing, the refractory metal foil layer reacts with the diamond body and substrate, and thereafter reacts with the diamond in the diamond body forming carbide. In addition to any bond provided with the diamond body by virtue of this reaction, plastic deformation of the refractory metal at the interface between the diamond and substrate operate to form an interlocking mechanical bond therebetween. The refractory meal foil layer also operates as a barrier to prevent unwanted infiltration of cobalt from the substrate into the diamond body. The container is removed from the device, and the resulting thermally stable diamond compact construction, comprising the thermally stable diamond body bonded to the substrate, is removed from the container. Subsequent examination of the compact reveals that the thermally stable diamond body is well bonded to the substrate.

This compact is machined to the desired size using techniques known in the art, such as by grinding and lapping. It is then tested in a dry high-speed lathe turning operation where the compact is used to cut a granite log without coolant. The thermally stable ultra-hard material compact of this invention displayed an effective service life that was greater than twice that of a conventional PCD compact.

A feature of thermally stable ultra-hard material compact constructions of this invention is that they include an ultra-hard material body having at least a region that is thermally stable, and that the body is attached to a substrate. A further feature is that the substrate is attached to the ultra-hard material body during a HPHT process separate from that used to form the ultra-hard material body to produce a strong bond therebetween. The bond strength between the ultra-hard material body and the substrate resulting from this process is much higher than that which can be achieved by other methods of attaching a substrate to thermally stable ultra-hard material bodies due to the ability to provide the bond at higher temperatures and pressures, while also preventing any diamond in the body from graphitizing.

Further, because the substrate is bonded to the ultra-hard material body, e.g., in the form of a thermally-stable diamond body, at a temperature that is generally below that used to form PCD, compacts formed according to this invention may have a more favorable distribution of residual stresses than compacts formed in a single HPHT cycle during which time both the PCD is formed and a substrate is attached thereto. In such a single HPHT cycle, the high temperatures necessary to form PCD are known to produce high levels of residual stress in the compact due to the relative differences in the thermal expansion properties of the PCD body and the substrate and due to shrinkage stresses created during sintering of the PCD material.

Further, because thermally stable ultra-hard material compact constructions of this invention are specifically engineered to permit the attachment of conventional types of substrates thereto, e.g., formed from WC—Co, attachment with different types of well known cutting and wear devices such as drill bits and the like are easily facilitated by conventional attachment techniques such as by brazing or welding.

Further still, thermally stable ultra-hard material compact constructions of this invention can include the use of an intermediate layer for the purpose of enhancing the bond strength, and/or preventing infiltration of solvent catalyst materials, and/or minimizing the difference in mechanical properties such as the coefficient of thermal expansion between the substrate and the body. Still further, thermally stable ultra-hard material compact constructions of this invention can include a ultra-hard body having a composite or laminate construction formed from a number of bodies that are specifically selected and joined together during the HPHT process to provide a resulting composite ultra-hard body having specially tailored properties of thermal stability, wear resistance, and fracture toughness.

Thermally stable ultra-hard material compact constructions of this invention can be used in a number of different applications, such as tools for mining, cutting, machining and construction applications, where the combined properties of thermal stability, wear and abrasion resistance are highly desired. Thermally stable ultra-hard material compact constructions of this invention are particularly well suited for forming working, wear and/or cutting components in machine tools and drill and mining bits such as roller cone rock bits, percussion or hammer bits, diamond bits, and shear cutters.

Figure 7:
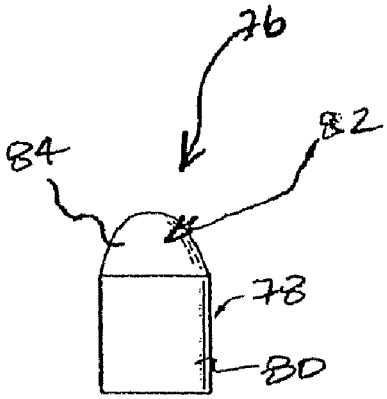
FIG. 7 is a perspective side view of an insert, for use in a roller cone or a hammer drill bit, comprising the thermally stable ultra-hard material compact construction of this invention.

FIG. 7 illustrates an embodiment of a thermally stable ultra-hard material compact construction of this invention provided in the form of a cutting element embodied as an insert 76 used in a wear or cutting application in a roller cone drill bit or percussion or hammer drill bit. For example, such inserts 76 can be formed from blanks comprising a substrate portion 78 formed from one or more of the substrate materials 80 disclosed above, and an ultra-hard material body 82 having a working surface 84 formed from the thermally stable region of the ultra-hard material body. The blanks are pressed or machined to the desired shape of a roller cone rock bit insert.

Figure 8:
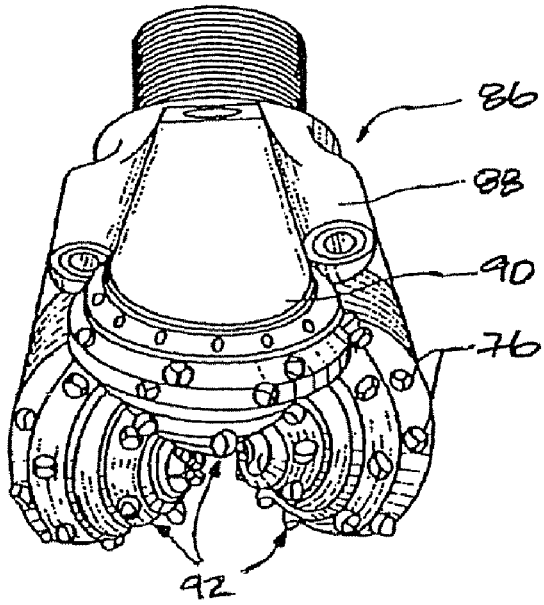
FIG. 8 is a perspective side view of a roller cone drill bit comprising a number of the inserts of FIG. 7.

FIG. 8 illustrates a rotary or roller cone drill bit in the form of a rock bit 86 comprising a number of the wear or cutting inserts 76 disclosed above and illustrated in FIG. 7. The rock bit 86 comprises a body 88 having three legs 90, and a roller cutter cone 92 mounted on a lower end of each leg. The inserts 76 can be fabricated according to the method described above. The inserts 76 are provided in the surfaces of each cutter cone 92 for bearing on a rock formation being drilled.

Figure 9:
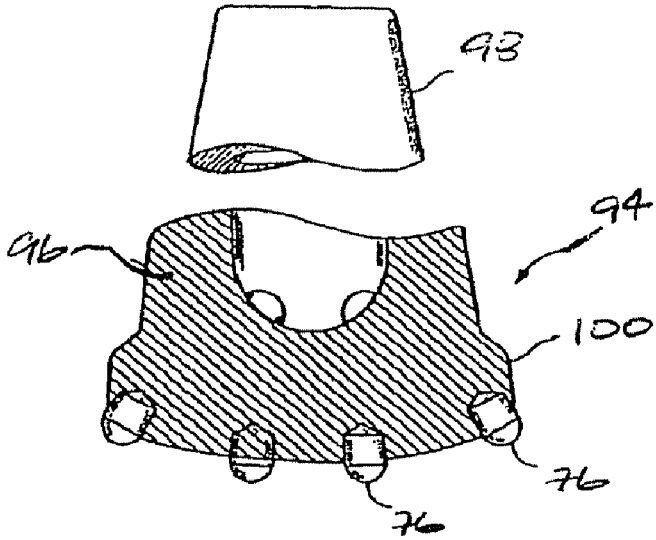
FIG. 9 is a perspective side view of a percussion or hammer bit comprising a number of inserts of FIG. 7.

FIG. 9 illustrates the inserts 76 described above as used with a percussion or hammer bit 94. The hammer bit comprises a hollow steel body 96 having a threaded pin 98 on an end of the body for assembling the bit onto a drill string (not shown) for drilling oil wells and the like. A plurality of the inserts 76 (illustrated in FIG. 7) are provided in the surface of a head 100 of the body 96 for bearing on the subterranean formation being drilled.

Figure 10:
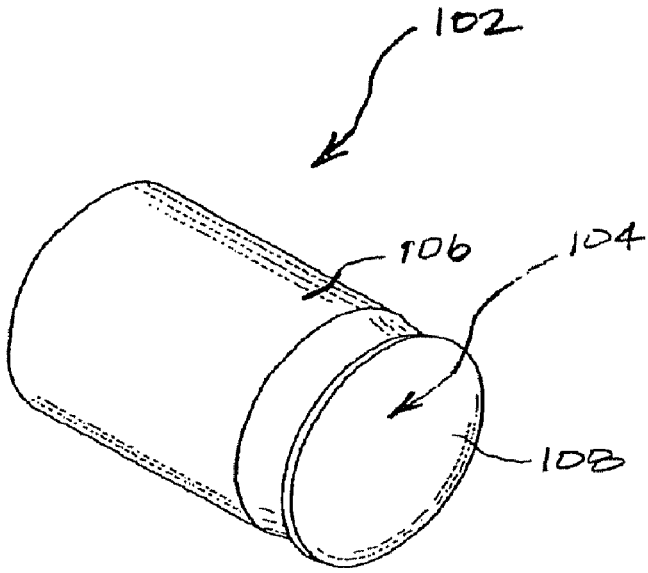
FIG. 10 is a schematic perspective side view of a diamond shear cutter comprising the thermally stable ultra-hard material compact construction of this invention.

FIG. 10 illustrates a thermally stable ultra-hard material compact construction of this invention as embodied in the form of a shear cutter 102 used, for example, with a drag bit for drilling subterranean formations. The shear cutter 102 comprises a thermally stable ultra-hard material body 104 that is sintered or otherwise attached/joined to a cutter substrate 106. The thermally stable ultra-hard material body includes a working or cutting surface 108 that is formed from the thermally stable region of the ultra-hard material body.

Figure 11:
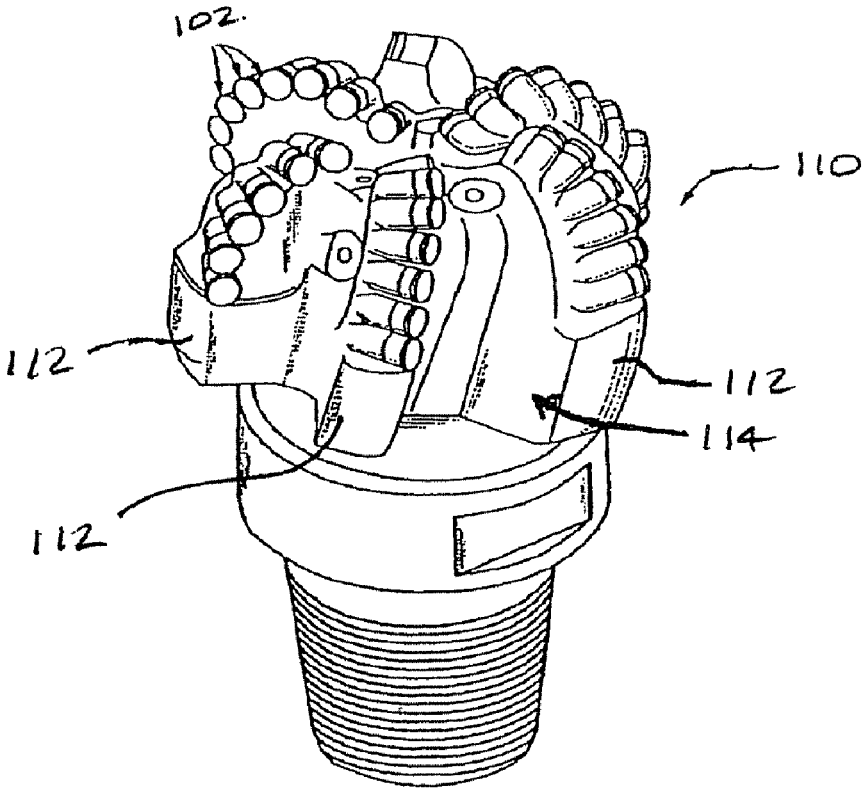
FIG. 11 is a perspective side view of a drag bit comprising a number of the shear cutters of FIG. 10.

FIG. 11 illustrates a drag bit 110 comprising a plurality of the shear cutters 102 described above and illustrated in FIG. 10. The shear cutters are each attached to blades 112 that extend from a head 114 of the drag bit for cutting against the subterranean formation being drilled.

Other modifications and variations of thermally stable ultra-hard material compact constructions will be apparent to those skilled in the art. It is, therefore, to be understood that within the scope of the appended claims, this invention may be practiced otherwise than as specifically described.

What is claimed is:

1. A method for making an ultra-hard element comprising the steps of:

forming an ultra-hard material body during a high pressure/high temperature process from materials selected from the group consisting of diamond, ceramic materials, diamond-like materials, cubic boron nitride, and mixtures thereof;

treating the body to produce a thermally stable region extending a depth from a working surface, the thermally stable region being substantially free of a material selected from Group VIII of the Periodic table; and placing a layer of intermediate material adjacent a surface of the body, wherein the intermediate material is selected from the group consisting of refractory metals, ceramics, non-refractory metals and combinations thereof.

2. The method as recited in claim 1 further comprising the step of attaching a substrate to the ultra-hard body.

3. The method as recited in claim 2 wherein the substrate is attached at a high pressure/high temperature condition.

4. The method as recited in claim 2 wherein the substrate is selected from the group of materials consisting of carbides, carbonitrides, cermets, and combinations thereof.

5. The method as recited in claim 1 wherein the intermediate material is a carbide material.

6. The method as recited in claim 5 wherein the intermediate material is tungsten carbide.

7. A method of making a thermally stable ultra-hard material compact construction comprising the steps of:

forming an ultra-hard material body during a high pressure/high temperature process from materials selected from the group consisting of diamond, ceramic materials, diamond-like materials, cubic boron nitride, and mixtures thereof;

treating the ultra-hard material body to produce a thermally stable region that is substantially free of a material selected from Group VIII of the Periodic table, the thermally stable region extending a depth into the body from a body surface and being thermally stable at temperatures greater than about 750° C.;

combining the ultra-hard material body with a metallic substrate, and having interposed therebetween an intermediate material, wherein the intermediate material is selected from the group consisting of refractory metals, ceramics, non-refractory metals and combinations thereof; and attaching the ultra-hard material body to the metallic substrate.

8. The method as recited in claim 7 wherein the step of attaching is performed by subjecting the ultra-hard material body, metallic substrate, and intermediate material to a high pressure/high temperature process.

9. The method as recited in claim 7 wherein after the step of forming, the thermally stable region has a grain hardness of greater than about 4,000 HV.

10. The method as recited in claim 7 wherein after the step of forming, the ultra-hard material body comprises a matrix phase of bonded-together diamond grains and interstitial regions dispersed within the matrix phase that comprises a Group VIII material, and after the step of treating, the thermally stable region comprises interstitial regions that are substantially free of the Group VIII material.

11. The method as recited in claim 10 wherein the thermally stable regions comprise interstitial regions that are substantially empty.

12. The method as recited in claim 7 wherein the intermediate material is provided in the form of a powder volume.

13. The method as recited in claim 7 wherein the intermediate material is provided in the form of a coating.

14. The method as recited in claim 7 wherein the intermediate material is a carbide material.

15. The method as recited in claim 14 wherein the intermediate material is tungsten carbide.

16. The method as recited in claim 7 wherein an interface surface between one or both of the body and the substrate are nonplanar.

17. A method of forming a thermally stable ultra-hard material compact construction comprising the steps of:

assembling a number of ultra-hard material body elements to form an ultra-hard material body, the body elements being selected from the group consisting of polycrystalline diamond, diamond, cubic boron nitride, polycrystalline cubic boron nitride, ceramics, and thermally stable materials selected from the group consisting of consolidated materials that are thermally stable at temperatures greater than about 750° C., wherein at least one of the body elements is formed from the thermally stable material, and wherein the thermally stable body element is positioned adjacent a surface of the ultra-hard material body;

combining the ultra-hard material body with a metallic substrate and interposing an intermediate material therebetween, wherein the intermediate material is selected from the group consisting of refractory metals, ceramics, non-refractory metals and combinations thereof;

joining the ultra-hard material body elements to one another to form the ultra-hard material body, and joining the ultra-hard material body to the metallic substrate by subjecting the ultra-hard material body elements, substrate, and intermediate material to a high pressure/high temperature process condition, thereby forming the compact construction.

18. The method as recited in claim 17 wherein at least one of the body elements is polycrystalline diamond, and the thermally stable material is bonded together diamond grains that is substantially free of solvent metal catalyst.

19. The method as recited in claim 17 wherein the intermediate material has a melting temperature that is greater than that of the high pressure/high temperature process condition.

20. The method as recited in claim 17 wherein the entire ultra-hard material body is formed from the thermally stable material.

* * * * *